US005243113A

United States Patent [19]

Nobusawa et al.

[11] Patent Number: 5,243,113

[45] Date of Patent: Sep. 7, 1993

[54] PROCESS FOR PREPARING 2-METHYLNAPHTHALENE

[75] Inventors: Tatsuya Nobusawa; Yoshinori Takagi; Toshihide Suzuki; Tsugio Horita, all of Chiba, Japan

[73] Assignee: Kawasaki Steel Corporation, Hyogo, Japan

[21] Appl. No.: 927,468

[22] Filed: Aug. 10, 1992

[30] Foreign Application Priority Data

Aug. 16, 1991 [JP] Japan ..... 3-205784
Mar. 13, 1992 [JP] Japan ..... 4-054817

[51] Int. Cl.[5] ..... C07C 5/27; C07C 7/06

[52] U.S. Cl. ..... 585/315; 585/478; 585/481

[58] Field of Search ..... 585/481, 478, 315

[56] References Cited

U.S. PATENT DOCUMENTS 3,000,983 9/1961 Homewood et al. .
3,075,890 1/1963 Chambers et al. .
3,481,996 12/1969 Kirk et al. .
3,504,045 3/1970 Scharf et al. .
3,860,668 1/1975 January et al. ..... 585/481
3,886,223 5/1975 Kemme et al. .
3,887,630 6/1975 Ward .

FOREIGN PATENT DOCUMENTS 0351074 1/1980 European Pat. Off. .
0475450 3/1992 European Pat. Off. .
0490349 6/1992 European Pat. Off. .
0518294 12/1992 European Pat. Off. .
2353327 10/1972 Fed. Rep. of Germany .
1124958 10/1956 France .
1-211143 3/1991 Japan .

OTHER PUBLICATIONS

Salinas et al. App. Catalysis, vol. 9 (1984) pp. 109-117.

*Primary Examiner*—Asok Pal
*Attorney, Agent, or Firm*—Bierman and Muserlian

[57] ABSTRACT

An economically advantageous process for preparing 2-methylnaphthalene is provided. The process comprises the steps of azeotropically distilling a 1-methylnaphthalene-containing oil with ethylene glycol to produce a denitrified oil; subjecting the denitrified oil to an isomerization to promote an isomerization from 1-methylnaphthalene to 2-methylnaphthalene and produce an isomerization product; and recovering 2-methylnaphthalene from the isomerization product. The process may further comprise the step of hydrodesulfurizing or hydrogenating a portion or all of the denitrified oil to produce a hydrodesulfurized or hydrogenated product so that the product alone or the product together with the non-hydrodesulfurized or hydrogenated oil can be subjected to the subsequent isomerization step. Catalytic life of the isomerization catalyst is markedly prolonged to enable a production of 2-methylnaphthalene at a high yield.

17 Claims, 3 Drawing Sheets

PROCESS FOR PREPARING 2-METHYLNAPHTHALENE

BACKGROUND OF THE INVENTION

This invention relates to a process for preparing 2-methylnaphthalene from a 1-methylnaphthalene-containing oil.

2-methylnaphthalene (hereinafter often abbreviated as 2-MN) has been quite useful as an intermediate in producing medicals such as Vitamin K, and more recently, as an intermediate in synthesizing 2,6-naphthalene dicarboxylic acid, which is a starting material for polyester resins having high heat resistance and high tensile strength 2-MN is contained in methylnaphthalene cut produced by distilling tar fraction generated in dry distillation of coal. Recovery of the 2-MN has been carried out by removing nitrogen-containing compounds, which primarily comprise basic substances, from the methylnaphthalene cut by washing the cut with sulfuric acid or by polymerizing with hydrochloric acid, followed by crystallization or distillation. The methylnaphthalene cut after undergoing the removal of the nitrogen-containing compounds contains a large amount of 1-methylnaphthalene (hereinafter often abbreviated as 1-MN) as well as the 2-MN, and therefore, a large amount of the 1-MN is present in the oil left after the recovery of the 2-MN by crystallization or distillation.

The 1-MN may be used for a dye and the like. Industrial demands for the 1-MN, however, are less compared to the 2-MN.

An isomerization of 1-MN to 2-MN is reported in V. Solinas et al., Applied Catalysis, 9, 1984, pages 109–117, and 5, 1983, pages 171–177, wherein various zeolites are used for the isomerization catalyst These references also deal with catalytic activity, life, and regeneration of the zeolites.

The catalytic life of the zeolite when used for an industrial production estimated from the decrease in the catalytic activity described in the references is as short as about 20 hours. Such a short catalytic life results in a requirement for a frequent catalyst regeneration, rendering the industrial production difficult.

Apart from the isomerization of the 1-MN to the 2-MN, Japanese Patent Publication No. 55(1980)-21018 (corresponding to U.S. Pat. No. 3,860,668) discloses an isomerization of an alkylbenzene, namely, a xylene mixture using silica/alumina catalyst wherein the isomerization is promoted in the presence of a cyclic hydrocarbon such as tetralin, decalin and cyclohexane in order to suppress the loss of xylene and carbon deposition on the catalyst.

The inventors of the present invention made an intensive study on the isomerization of a stock oil containing the 1-MN in the presence of a solid catalyst to produce an equilibrium composition of the 1-MN and the 2-MN, so that the 2-MN may be recovered from the equilibrated composition. Through the study, the inventors found that the process involves a serious problem that catalytic activity of the solid acid catalyst used in the isomerization decreases in a quite short period, and a solution of the problem would be required for completing an economically advantageous process for producing the 2-MN from the 1-MN containing stock oil.

In view of the state of the art as described above, an object of the present invention is to provide a method for producing 2-MN from an 1 MN-containing oil by catalytically isomerizing 1-MN in the 1-MN-containing oil to 2-MN wherein activity of the isomerization catalyst is retained at a high level for a prolonged period of time, and wherein the 2-MN product may be produced economically at a high yield.

After an intensive study to achieve the above-mentioned object, the inventors of the present invention have found that a cause for the deterioration of the isomerization catalyst is the nitrogen-containing compounds in the 1-MN-containing oil, and substantially full removal of the nitrogen compounds from the 1-MN-containing oil is quite important, and an azeotropic distillation in the presence of ethylene glycol is quite favorable for such a substantially full removal of the nitrogen compounds in view of retaining the catalytic activity of the isomerization catalyst.

Furthermore, the inventors of the present invention have also unexpectedly found that, hydrodesulfurization of the 1-MN-containing oil before the isomerization results in a prolonged catalytic life of the solid acid catalyst used for the isomerization It was found that a small amount of tetralin compounds such as methyltetralin and tetralin were formed by hydrogenation of aromatic ring of a part of the methylnaphthalene and the naphthalene in the 1-MN-containing oil during the hydrodesulfurization of the 1 MN-containing oil, and the thus formed small amount of the tetralin compounds were effective for the suppression of the deactivation or degradation of the solid acid catalyst to realize a prolonged catalytic life, and furthermore, the catalytic life of the solid acid catalyst may be even more prolonged when the content of the methyltetralin in the stock oil fed to the isomerization step is regulated by using the tetralin compounds formed in the hydrodesulfurization.

Hydrodesulfurization is a step which is generally employed for the removal of the sulfur compounds, and we were quite astonished to unexpectedly find that the hydrodesulfurization step effected prior to the isomerization would result in such an efficient isomerization whose productivity may be retained for a prolonged period. The undesirable sulfur compounds would of course be removed from the system by the hydrodesulfurization, and the resulting 2-MN product would have a high purity, whereby the desulfurization purpose is also attained.

It was also found that a similar effect would be realized when only a hydrogenation is carried out instead of the hydrodesulfurization.

The above-mentioned object of the present invention has been attained by a series of the findings as described above.

The object of the present invention is attained by three comprehensive aspects of the present invention as described below.

The first aspect of the present invention is directed to a process for preparing 2-methylnaphthalene comprising the steps of azeotropically distilling a 1-methylnaphthalene-containing oil with ethylene glycol to produce a 1-methylnaphthalene-containing oil having a reduced content of nitrogen compounds;

subjecting the 1-methylnaphthalene containing oil having the reduced content of nitrogen compounds to an isomerization treatment to promote an isomerization from 1-methylnaphthalene to 2 methylnaphthalene and produce an isomerization product; and recovering 2-methylnaphthalene from the isomerization product.

The second aspect of the present invention is directed to a process for producing 2-MN further comprising the step of hydrodesulfurizing a portion or all of the 1-methylnaphthalene-containing oil having the reduced content of nitrogen compounds obtained by the azeotropic distillation to produce a hydrodesulfurized product so that the hydrodesulfurized product alone or the hydrodesulfurized product together with the non-hydrodesulfurized 1-methylnaphthalene-containing oil can be subjected to the subsequent isomerization step.

The third aspect of the present invention is directed to a process for preparing 2-MN further comprising the step of hydrogenating a portion or all of the 1-methylnaphthalene-containing oil having the reduced content of nitrogen compounds obtained by the azeotropic distillation to produce a hydrogenated product so that the hydrogenated product alone or the hydrogenated product together with the non-hydrogenated 1-methylnaphthalene-containing oil can be subjected to the subsequent isomerization step.

The process of the present invention is quite effective when the 1-MN-containing oil is a MN containing cil produced from coal tar.

DETAILED DESCRIPTION OF THE INVENTION

Figure 1:
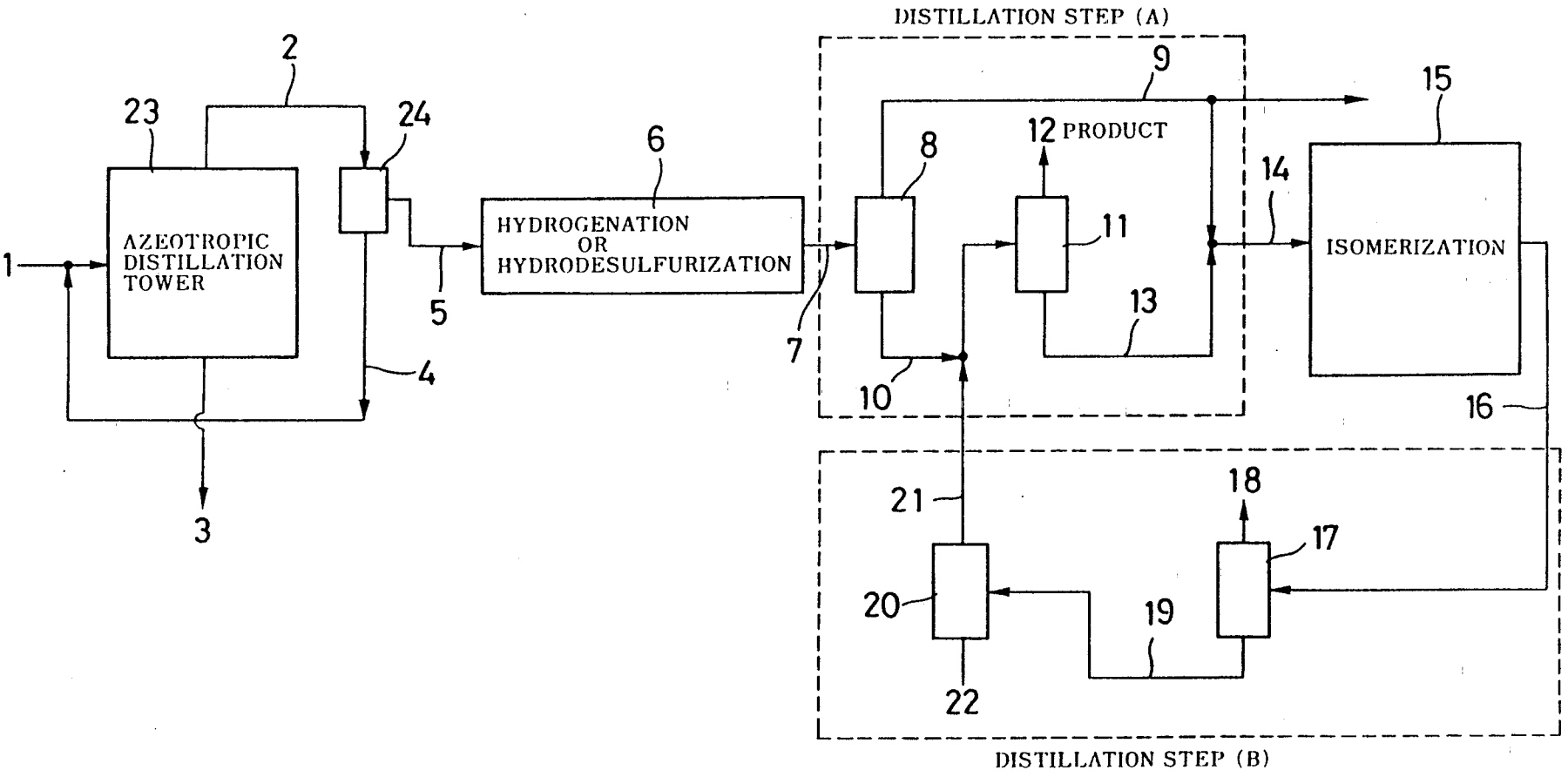
FIG. 1 is a flow chart illustrating an embodiment of the process for producing 2-MN according to the present invention.

The present invention is hereinafter described in further detail to show preferred embodiments of the present invention and to demonstrate various merits of the present invention.

1-MN-containing oil

The starting stock employed in the process of the present invention is a 1 MN-containing oil Typical 1-MN-containing oils include an oil produced by distilling off lower boiling components such as naphthalene from wash oil obtained by distillation of coal tar, which is a byproduct, for example, in a coke oven of ironworks.

The 1-MN containing oil employed in the present invention may preferably be a cut derived from coal tar containing 10% by weight or more in total of the 1-MN and the 2-MN. Such a 1-MN-containing oil typically contains 0.2 to 2% by weight calculated in terms of elemental nitrogen of nitrogen-containing compounds such as quinoline, isoquinoline and indol In addition, such a 1-MN-containing oil typically contains 0.1 to 2% by weight of sulfur compounds calculated in terms of elemental sulfur.

Azeotropic distillation of 1-MN-containing oil

In the process of the present invention, the 1-MN-containing oil is first azeotropically distilled with ethylene glycol to obtain a 1-MN-containing oil having a reduced content of the nitrogen compounds before subjecting the oil to an isomerization step.

The content of the nitrogen compounds may preferably be reduced to 500 ppm or less, and more preferably, to 100 ppm or less calculated in terms of elementary nitrogen before the isomerization.

In the azeotropic distillation, an amount of the ethylene glycol required for azeotropic distillation of methylnaphthalene is mixed with the 1-MN-containing oil. Such an azeotropic amount may be determined by referring to a reference, for example, Azeotropic Data, No 6 of the Advances in Chemistry Series, American Chemical Society, page 68, 1952, which discloses an ethylene glycol/2-methylnaphthalene molar ratio of 1.34 and an ethylene glycol/1-methylnaphthalene molar ratio of 1.5 as each azeotrope composition.

In other words, the molar amount of the ethylene glycol added to the 1-MN-containing oil to be distilled may be an amount somewhat larger than sum of 1.5 times the 1-MN content plus 1.34 times the 2-MN content. The amount of the ethylene glycol added may be somewhat smaller than the above-mentioned amount in sacrifice of the recovery of the methylnaphthalene. As in the conventional azeotropic distillation, the azeotropic distillation of the present process may be carried out either continuously or in batchwise, and either under a normal pressure or under a reduced pressure.

The azeotrope can be recovered as a top fraction, and when cooled and allowed to stand for a considerable period, the azeotrope separates into an upper layer containing methylnaphthalene components and a lower layer containing ethylene glycol component The methylnaphthalene components are thereby readily obtained. The nitrogen compounds are separated as bottom components.

By the procedure as described above, a 1-MN cut substantially free from nitrogen compounds, namely, with a nitrogen content of approximately 500 ppm or less, preferably 100 ppm or less calculated as elemental nitrogen may be produced. It is preferable that this 1-MN cut contains as the sum of 1-MN and 2-MN an amount of not less than 80% by weight.

By feeding the thus produced 1-MN cut having such a reduced content of the nitrogen compounds, life of the isomerization catalyst may be significantly prolonged compared with the use of a non-denitrified 1-MN cut.

However, life of the isomerization catalyst may be even further prolonged by subjecting the denitrified 1-MN cut to a hydrodesulfurization or a hydrogenation step before feeding it to the subsequent isomerization step. The hydrodesulfurization and the hydrogenation step may be carried out as described below.

Hydrodesulfurization

The hydrodesulfurization employed in the process according to the second aspect of the present invention is carried out primarily for removing sulfur compounds contained in the 1-MN-containing oil. The hydrodesulfurization may be carried out in accordance with any known procedure. The extent of the removal of the sulfur compounds may be determined in accordance with the specification of the 2-MN product.

The catalyst used in the hydrodesulfurization may be a catalyst having loaded thereto at least one of molybdenum, cobalt and nickel Illustrative catalysts include catalysts comprising molybdenum and at least one member selected from cobalt and nickel on an alumina support, such as cobalt-molybdenum/alumina, nickel-molybdenum/alumina, cobalt-nickel-molybdenum-/alumina. The catalyst which may be used in the hydrodesulfurization step is not limited to the above-mentioned catalyst so long as the catalyst employed is capable of promoting both the hydrodesulfurization and the hydrogenation of aromatic ring of methylnaphthalene and/or naphthalene. Furthermore, the catalyst may additionally include elements other than those mentioned above in an amount that does not detract from the purpose of the present invention.

The hydrodesulfurization may preferably be carried out under the reaction conditions including a temperature of 240° to 400° C., and more preferably 260° to 350° C. and a pressure of normal pressure to 100 kgf/cm$^2$G, and more preferably 1.0 to 20 kgf/cm$^2$G. The liquid hourly space velocity (LHSV, amount of the stock oil fed per 1 liter of the catalyst) in the hydrodesulfurization may typically be 0.1 to 10.0 hr$^{-1}$.

Ratio of the hydrogen flow rate to the oil flow rate, GHSV (hr$^{-1}$) /LHSV (hr$^{-1}$) may preferably be 30 or more.

By hydrodesulfurizing the denitrified oil under the conditions as described above, the sulfur compounds which were originally included in the 1-MN-containing oil would be hydrogenated and decomposed into low-boiling point components, which may be removed by such means as distillation. A 1 MN-containing oil substantially free from sulfur compounds is thereby obtained, which typically includes about 0 1 to 5% by weight of tetralin compounds.

Either all or a part of the denitrified 1-MN-containing oil may be fed to the hydrodesulfurization step. Any desired mode may be appropriately selected depending on the content of sulfur compounds in the 1-MN-containing oil, the specifications of the 2-MN product, and the content of tetralin compounds in the 1-MN containing oil fed to the subsequent isomerization step.

Hydrogenation

According to the third aspect of the present invention, the denitrified 1-MN-containing oil is subjected to a hydrogenation, which does not involve desulfurization instead of the hydrodesulfurization to thereby obtain a 1-MN-containing oil containing 0.1 to 10% by weight, preferably 0.2 to 5% by weight of the tetralin compounds, which are generated by hydrogenation of a part of the methylnaphthalene and/or the naphthalene in the 1-MN-containing oil.

The hydrogenation which does not involve the desulfurization may preferably be employed when the 1-MN-containing oil treated has a sufficiently low sulfur content that no desulfurization is required, or when the specifications of the 2-MN product do not include any strict standard with regard to the sulfur content.

The hydrogenation may be carried out by the procedure and under the conditions as described above for the hydrodesulfurization. However, the hydrogenation, whose purpose is not the desulfurization but primarily hydrogenation of aromatic ring of some of the methylnaphthalene and/or naphthalene, may be carried out under conditions more moderate than those of the hydrodesulfurization. For example, the hydrogenation may be carried out under a pressure of 0 to 100 kgf/cm$^2$G and a temperature of 100° to 500° C. using a copper-chromite catalyst or a catalyst containing at least one member selected from Group VIII metals such as nickel, platinum and palladium; or the like.

The hydrogenation conditions may be determined without undue experimentation so that the hydrogenated 1-MN-containing oil would contain the tetralin compounds at desired concentration.

Either all or a part of the denitrified 1-MN-containing oil may be fed to the hydrogenation step. The proportion of the denitrified 1-MN-containing oil which may be subjected to the hydrogenation may be determined depending on the content of the tetralin compounds in the 1-MN-containing oil fed to the subsequent catalytic isomerization step.

Isomerization

The 1-MN-containing oil which is fed to the isomerization step has a 2-MN concentration lower than the 2-MN concentration in the equilibrium composition. When the 2-MN concentration of the 1-MN-containing oil is higher than the 2-MN concentration in the equilibrium composition, 2-MN should be removed from the system as a product by such an operation as distillation to thereby reduce the 2-MN concentration to below the equilibrium concentration.

Furthermore, the 1-MN-containing oil fed to the isomerization step may preferably include 0.1 to 10% by weight, and more preferably 0.2 to 5% by weight of the tetralin compounds.

The catalyst used for the isomerization is not particularly limited so long as the catalyst has an isomerizing activity to convert the 1-MN to the 2-MN. Exemplary catalysts include solid acid catalysts such as silica-alumina, alumina and zeolite. Preferred is zeolite Y, and the most preferred is dealuminated zeolite Y having a lattice constant of more than 24.2 Å and up to 24.37 Å.

For zeolite Y, it is generally known that the lattice constant would become smaller when the content of the aluminum constituting the frame work is reduced. Therefore, the lattice constant may be used as an index for the content of the aluminum which constitutes the frame work of the zeolite. The relation between the content of the aluminum constituting the frame work and the lattice constant may be found, for example, in H. Fichtner Schmittler et al., Crystal Research and Technology, 19, 1984, 1, K1–K3. According to this reference, an extrapolated lattice constant value corresponding to the aluminum content of 0% after gradual dealumination of the zeolite Y is 24.2 Å. The above mentioned zeolite Y having the range of the lattice constant of 24.37 Å or less, therefore, is a zeolite Y whose ratio $SiO_2Al_2O_3$ is quite high. In the present invention, the lattice constant may preferably be in the range of 24.27 to 24.35 Å, and most preferably, in the range of 24.28 to 25.34 Å.

The zeolite Y which is used as a starting material for producing the zeolite Y having the lattice constant of less than or equal to 24.37 Å may have any $SiO_2/Al_2O_3$ ratio. However, use of a commercially available zeolite USY (ultrastabled Y) having an elevated $SiO_2/Al_2O_3$ ratio is preferable in view of a smooth dealumination.

The above-mentioned dealuminated zeolite Y is preferred since it may retain its catalytic activity for a period longer than other zeolites. Adjustment of the lattice constant by the dealumination may be carried out by any known method such as a treatment with steam or an acid.

The solid acid catalysts having a Group VIII metal such as Fe, Co, Ni, Pd, or Pt supported thereon, which are prepared by ion exchange method, can be used also as the catalyst for the present invention.

The solid acid catalyst is capable of dehydrogenating tetralin compounds In other words, methyltetralin undergoes a dehydrogenation reaction to generate methylnaphthalene, and subsequently there occurs an isomerization reaction by which 1-MN is converted into the target 2-MN.

The isomerization may be carried out either continuously or in batchwise However, a continuous isomerization is economically advantageous for an industrial mass-production. Also, the isomerization may be carried out either in gas phase or liquid phase. The reaction temperature is typically in the range of 200° to 600° C., and preferably, in the range of 350° to 600° C. The isomerization may be promoted either at normal pressure or under slightly or highly pressurized conditions. The isomerization may typically be promoted in gas or liquid phase at a pressure in the vicinity of normal pressure to 50 kg/cm$^2$G.

The isomerization in gas phase may be conducted either in the presence or in the absence of a dilution gas, for example, nitrogen, steam or hydrogen. Use of hydrogen for the dilution gas is preferable for retaining the catalytic activity. In the isomerization reaction, a dilution with a larger amount of the dilution gas may result in better retention of the catalytic activity. However, under the presence of a sufficient amount of the tetralin compounds in the system, the catalytic activity would be retained at a high level even when reactants are diluted with a smaller amount of the dilution gas. No substantial reduction in the catalytic activity would be induced even without a dilution gas when the tetralin compounds are sufficiently present at a level corresponding to the type of the catalyst and the reaction conditions. In other words, a ccnsiderable reduction in the amount of the dilution gas may be enabled by the process of the present invention.

The isomerization may preferably be carried out at a weight hourly space velocity (WHSV, weight of the 1-MN passing through the catalyst in one hour) in the range of 0.1 to 10 hr$^{-1}$. A WHSV exceeding this range would result in an insufficient conversion, whereas a WHSV below this range is uneconomical since a larger amount of the catalyst and a larger reactor would be required.

The 1-MN in the 1-MN-containing oil may be isomerized into the 2-MN as described above. The isomerization product may subsequently be treated by such means as distillation to recover the 2-MN from the system.

An embodiment of the 2-MN production according to the first to third aspects of the invention is described by referring to an exemplary production illustrated in the flowchart of FIG. 1. The process of the present invention is not limited to the one illustrated in the flowchart of FIG. 1, but may also be carried out by appropriately modifying the combination of unit operations First, a stock oil 1 is introduced into an azeotropic distillation tower 23 together with ethylene glycol for an azeotropic distillation to thereby remove nitrogen compounds present in the stock oil 1 and produce an azeotropically distilled composition 2. The composition 2 is introduced into a separation tank 24, and allowed to stand to separate ethylene glycol 4 from a MN-containing oil 5. The separated ethylene glycol 4 is recycled into a feed line to the azeotropic distillation tower 23. The MN-containing oil 5 is transferred to the subsequent hydrogenation or hydrodesulfurization step 6 wherein a hydrogenated or hydrodesulfurized oil 7 is produced.

Next, the hydrogenated or hydrodesulfurized oil 7 is subjected to a distillation step (A) comprising a distillation tower 8 and a rectification tower 11. The hydrogenated or hydrodesulfurized oil 7 is first introduced in the distillation tower 8 wherein a top cut 9 containing impurities having boiling points lower than the 2-MN is removed to leave a bottom cut 10. The removed impurities mainly comprise methyltetralin, and may additionally contain tetralin, alkylbenzene and naphthalene. The bottom cut 10 is fed to rectification tower 11 together with a top cut 21 recycled from a distillation tower 20 in a subsequent distillation step (B). A cut 12 comprising the product 2-MN is separated in the rectification tower 11 to leave a cut 13, which is mixed with a part or all of the methyltetralin-containing cut 9 to form a stock material 14 for the subsequent isomerization in an isomerization installation 15. The operative conditions in the distillation tower 8 and the rectification tower 11 may be appropriately determined so that the stock material 14 for the subsequent isomerization would have a 1-MN content of 35% by weight or higher, and more preferably 50% by weight or more. When the stock material 14 has a 1-MN content of less than 35% by weight, isomerization efficiency would be reduced in view of thermodynamic equilibrium Upper limit for the 1-MN content of the stock material 14 is not particularly limited, but is industrially determined by the design and operation conditions of the distillation towers 8 and 11.

The stock material 14 produced in the distillation step (A) is fed to the isomerization installation 15 wherein the 1-MN is isomerized into 2-MN to produce a cut 16.

All or a part of the top cut 9 removed from the distillation tower 8, which mainly comprises methyltetralin, and which may further include tetralin, is fed to the isomerization step As a consequence, the life of the solid acid catalyst used in the isomerization step is markedly prolonged.

The stock material 14 may have any desired content of the methyltetralin, or the methylteralin and the tetralin, by regulating the amount of the portion of the top cut 9, which is mixed with the cut 13.

The cut 16 which has experienced the isomerization is then fed to the distillation step (B) comprising distillation towers 17 and 20, wherein low boiling components as well as high boiling components formed in the hydrogenation or the hydrodesulfurization step and the isomerization step are removed from the system. More illustratively, components 18 having boiling points lower than the methylnaphthalene are removed from the system in points higher than the methylnaphthalene are removed from the system in the distillation tower 20. The resulting top cut 21 from the distillation tower 20 is recycled to the distillation step (A), wherein the cut 21 is mixed with the cut 10.

Figure 2:
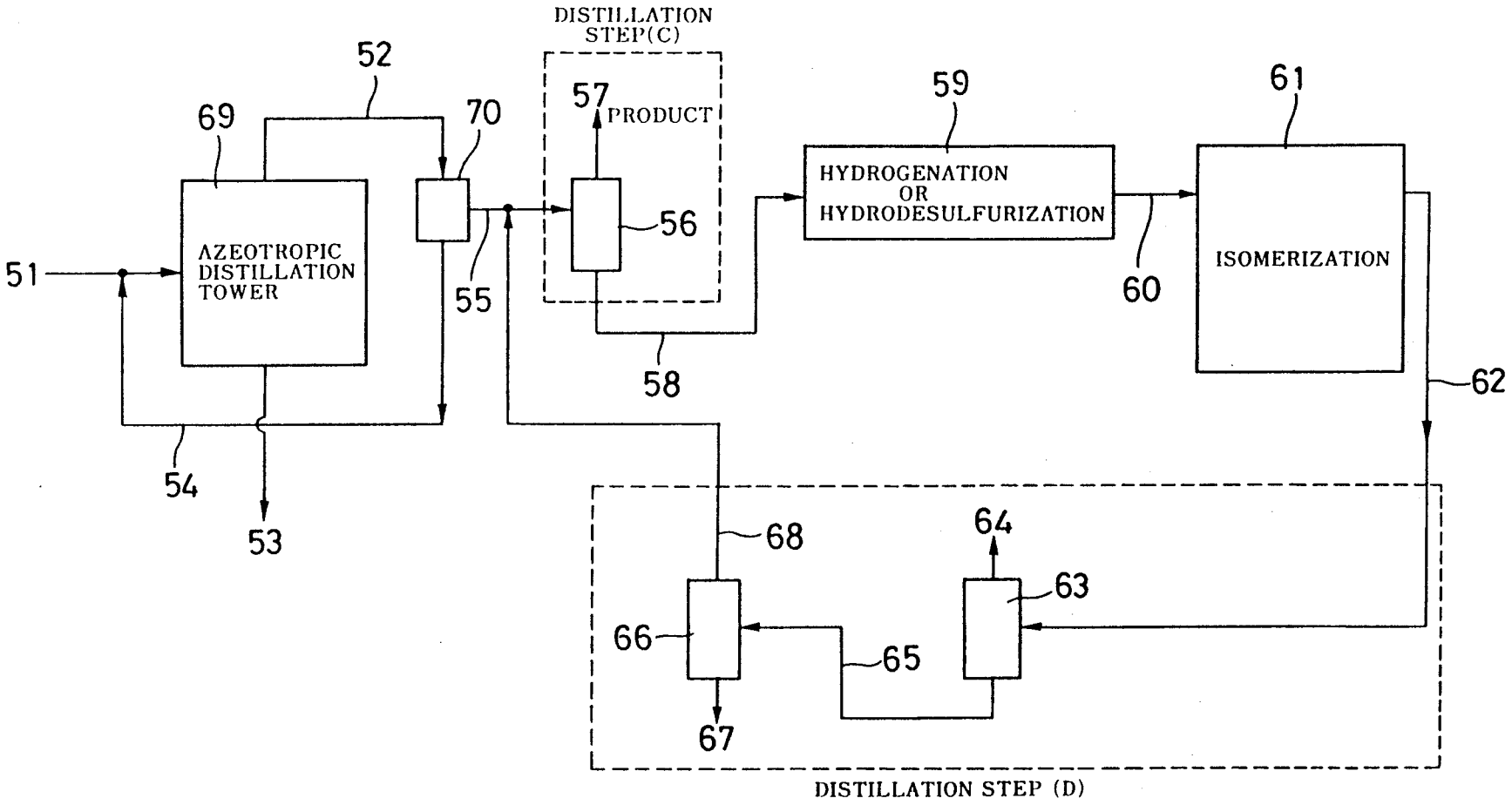
FIG. 2 is a flow chart illustrating another embodiment of the process for producing 2-MN according to the present invention.

Another embodiment of the production is described by referring to the flowchart of FIG. 2. As in the case of FIG. 1, a 1-MN containing oil 51 containing nitrogen compounds is fed to an azeotropic distillation tower 69 together with ethylene glycol 54 to produce a cut 55 having a reduced content of the nitrogen compounds. The cut 55 together with a cut 68 recycled from a distillation step (D) is fed to a distillation step (C) wherein the feed is distilled in a rectification tower 56 to obtain a top cut 57, which is the target product 2-MN and leave a bottom cut 58, which primarily comprises 1-MN and 2-MN. The bottom cut 58 is fed to a hydrogenation or a hydrodesulfurization step 59 to produce a hydrogenated or hydrodesulfurized oil 60 containing a small amount of tetralin compounds. The oil 60 is fed to an isomerization step 61 to obtain an isomerization product 62 having an equilibrium composition or a composition similar to the equilibrium composition. The isomerization product 62 is then fed to the distillation step (D) wherein low boiling components 64 and high boiling components 67 are removed from the system in distillation towers 63 and 66, respectively to obtain the cut 68 primarily comprising the 1-MN and the 2-MN. The cut 68 is recycled to the distillation step (C).

It is to be noted that the distillation in the distillation towers 23, 8, 11, 17, 20, 69, 56, 63 and 66 may be carried out either continuously or in batchwise. Either mode may be appropriately selected. The continuous distillation is not so complicated The batchwise distillation requires less expenditure for the installation since all distillation steps may be carried out in one distillation tower and the cut produced in each step may be stored in a tank or the like so that the next distillation step may be carried out in the same distillation tower, but under different conditions.

As described above, various processes for producing the 2-MN may be constructed by appropriately combining various distillation steps in accordance with the first to third aspect of the present invention.

The present invention is hereinafter described in further detail by referring to the following non-limiting Examples and Comparative Examples.

EXAMPLES

Example 1

2-methylnaphthalene (2-MN) was produced in accordance with the procedure illustrated in the flowchart of FIG. 1. Wash oil produced by distilling coal tar, having the composition as shown in Table 1, was used for the starting stock. Various cuts generated in the production had the compositions as shown in Table 2. To an azeotropic distillation tower were supplied the starting wash oil and ethylene glycol in a weight ratio of 100 to 140 (wash oil:ethylene glycol) at 28th stage of 36 theoretical stages, and continuous distillation was carried out at a reflux ratio of 5.0. The denitrified cut 5 had a nitrogen content of 0.005% by weight, and recovery of the methylnaphthalene based on the methylnaphthalene in the wash oil was 90% by mole. The denitrified cut 5 was subjected to hydrodesulfurization in a fixed-bed catalytic tubular flow reactor packed with a commercially available hydrodesulfurization catalyst which comprises alumina support having loaded thereto cobalt and molybdenum at a reaction temperature of 300° C., a reaction pressure of 2 kgf/cm$^2$.G, an LHSV of 1.0 hr$^{-1}$, and a GHSV of 100 hr$^{-1}$ to obtain a cut 7 wherein content of sulfur compounds had been reduced to 0.3% by weight. Next, the cut 7 was subjected to distillation step (A) wherein a cut 9 was distilled off from a distillation tower 8 to leave a cut 10 having a content of 2-MN of 64.7% by weight, and the cut 10 was further distilled in a distillation tower 11 to withdraw a 2 MN cut 12, which was the target product, and leave a cut 13. The 2-MN cut 12 had a product purity of 98.0% by weight and a concentration of sulfur compounds of 0.3% by weight. The cut 9 distilled off in the distillation step (A) was mixed with the cut 13 to produce a mixed stock 14 having a methyltetralin content of 2.6% by weight and a 1-MN content of 67.2% by weight. Proportion of the 2-MN in total of the 1-MN and the 2-MN was 25% by weight.

Next, the stock 14 was fed to an isomerization installation having packed therein a solid acid catalyst comprising dealuminated zeolite Y having a $SiO_2/Al_2O_3$ ratio by mole of 36 and a lattice constant of 24.30 Å wherein cationic sites had been exchanged with protons The stock 14 was subjected to an isomerization treatment at a reaction temperature of 450° C. and a WHSV (weight hourly space velocity; weight of the stock material which passes through the catalyst of a unit weight per one hour) of 1.5 hr$^{-1}$ in order to isomerize the 1-MN into 2-MN and to obtain an isomerized cut 16 wherein the proportion of the 2-MN in total of the 1-MN and the 2-MN had been increased to 62% by weight. The isomerized cut 16 was subjected to distillation step (B) to recover a methylnaphthalene-containing cut 21 having a 2-MN content of 66.2% by weight The cut 21 was recycled into the cut 10 which had resulted in the distillation step (A) Recovery of the 2-MN in the cut 12 was 113% by weight based on the amount of the 2-MN which had been contained in the stock wash oil.

In the isomerization step of this Example, activity of the isomerization catalyst was maintained at a fair level throughout 330 days of the operation. More illustratively, the cut 16 had a 2-MN content of 56.5% by weight at the start of the operation, and the 2-MN content of the cut 16 was 50.0% by weight after the 330 days of operation

TABLE 1

Composition of the wash oil

| Constituent | % by weight |
|---|---|
| naphthalene | 6.3 |
| 2-methylnaphthalene | 22.1 |
| 1-methylnaphthalene | 8.8 |
| quinoline | 4.5 |
| isoquinoline | 1.2 |
| diphenyl | 5.2 |
| dimethylnaphthalene | 6.9 |
| acenaphthene | 14.2 |
| indol | 2.2 |
| methylbenzothiophene | 2.1 |
| others | 26.5 |
| Nitrogen content | 0.8 |
| Sulfur content | 0.6 |

TABLE 2

Composition of various cuts in Example 1 (in % by weight)

| Constituents | Cut No. 5 | 7 | 10 | 12 | 14 | 16 | 21 |
|---|---|---|---|---|---|---|---|
| 2-MN*1 | 65.2 | 64.2 | 64.7 | 98.0 | 22.2 | 56.5 | 66.2 |
| 1-MN | 29.7 | 29.2 | 33.1 | 1.5 | 67.2 | 34.3 | 32.8 |
| MT*2 | 0 | 1.5 | 0.1 | 0.1 | 2.6 | 0.2 | 0.1 |
| Others | 2.1 | 4.8 | 1.8 | 0.1 | 7.7 | 8.7 | 0.6 |
| S compounds | 3.0 | 0.3 | 0.3 | 0.3 | 0.3 | 0.3 | 0.3 |
| 2-MN yield*3 | | | | 113 | | | |
| 2-MN/MN*4 | 69 | 69 | 66 | 99 | 25 | 62 | 67 |

*1MN is an abbreviation for methylnaphthalene.
*2MT is an abbreviation for methyltetralin.
*3yield was calculated on the bases of the amount of the 2-MN in the wash oil cut 1.
*4ratio of the amount of 2-MN to the total amount of 1-MN and 2-MN.

EXAMPLE 2

Figure 3:
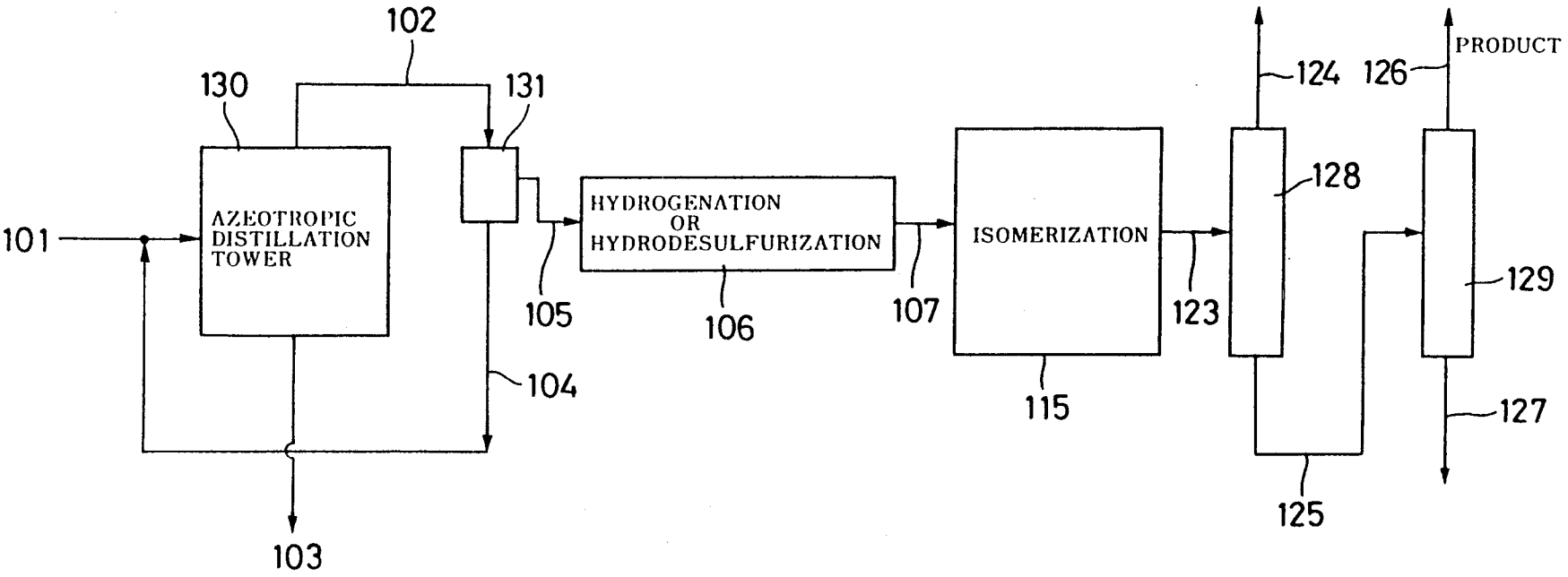
FIG. 3 is a flow chart illustrating a further embodiment of the process for producing 2-MN according to Example 2 of the present invention.

2-methylnaphthalene (2-MN) was produced in accordance with a procedure illustrated in the flowchart of FIG. 3. Various cuts generated in the production had the compositions as shown in Table 3. Cut 101 shown in Table 3 was 1-MN-containing oil having a nitrogen content of 0.8% by weight. The cut 101 was azeotropically distilled with ethylene glycol in the same manner as Example 1, and the resulting denitrified 1-MN-containing oil having a nitrogen content of 0.003% by weight and a concentration of sulfur compounds of 2.8% by weight was hydrodesulfurized in the same manner as the Example 1 to obtain a cut 107, whose content of the sulfur compounds had been reduced to 0.4% by weight. The cut 107 had a total content of tetralin and methyltetralin of 1.0% by weight with the tetralin/methyltetralin molar ratio of 1/9 and nuclear hydrogenation proportion of 1.1% by mole, and a 2-MN proportion in the total of the 1-MN and the 2-MN of 25% by weight.

Next, the cut 107 was fed to an isomerization step utilizing an isomerization installation having packed therein the same solid acid catalyst as the one used in Example 1, and the isomerization was promoted under the same conditions as Example 1 to obtain a cut 123, wherein the 2-MN proportion in the total of the 1-MN and the 2-MN had been increased to 64% by weight.

The cut 123 was subjected to a distillation step wherein lower boiling components 124 were separated in distillation tower 128 and removed therefrom, and higher boiling components 127 were subsequently separated in distillation tower 129 and removed therefrom to recover a 2-MN cut 126, which was the product.

Recovery of the 2-MN in the product was 180% by weight based on the amount of the 2-MN contained in the stock wash oil 101. The 2-MN product had a purity of 97.0% by weight and a concentration of sulfur compounds of 0.4% by weight In the isomerization step of this Example, activity of the isomerization catalyst was maintained at a fair level throughout 150 days of the operation. More illustratively, the cut 123 had a 2-MN content of 48.5% by weight at the start of the operation, and the 2-MN content in the same cut was 45.0% by weight after the 150 days of the operation.

TABLE 3

Composition of various cuts in Example 2 (in % by weight)

| Constituents | Cut No. 101 | 105 | 107 | 123 | 126 |
|---|---|---|---|---|---|
| 2-MN | 7.5 | 20.0 | 19.6 | 48.5 | 97.0 |
| 1-MN | 24.0 | 60.0 | 59.4 | 27.4 | 2.0 |
| MTs*[1] | 0.0 | 0.0 | 1.0 | 0.1 | 0.1 |
| Others | 66.1 | 17.2 | 19.6 | 23.6 | 0.5 |
| S compounds | 2.4 | 2.8 | 0.4 | 0.4 | 0.4 |
| 2-MN yield | | | | | 180 |
| 2-MN/MN | | | 25 | 64 | |

*[1]MTs: sum of tetralin plus methyltetralin.

EXAMPLE 3

To 100 parts by weight of the wash oil produced by distilling coal tar, having the composition a shown in Table 1, was added 40 parts by weight of ethylene glycol. The mixture was batch-distilled in a packed column of 50 theoretical stages at a reflux ratio of 10 to obtain 29 parts by weight of methylnaphthalene Cut, which had a methylnaphthalene content of 97.0% by weight, a sulfur content of 0.6% by weight, and a nitrogen content of 0.005% by weight. Recovery of the methylnaphthalene based on the amount of the methylnaphthalene in the wash oil was 91% by mole.

This methylnaphthalene cut was distilled to obtain an oil having a 1-MN content of 75%. This oil was catalytically isomerized using zeolite Y whose cationic sites had been ion-exchanged with protons. The isomerization was conducted in a gas-phase fixed-bed catalytic flow reactor using hydrogen as diluting gas at 450° C., standard pressure, an LHSV of 1.5 $hr^{-1}$, and a GHSV of 2,400 $hr^{-1}$. Recovery of 2-methylnaphthalene is shown in Table 4.

Comparative Example 1

For comparison purpose, the wash oil was distilled in the absence of ethylene glycol to obtain a methylnaphthalene-containing oil having a 1-MN content of 75%, and this oil was isomerized by repeating the isomerization procedure of Example 3. The results are shown in Table 4.

TABLE 4

Recovery of 2-methylnaphthalene, % by weight

| | Time after the start of the reaction, hr 10 | 20 | 50 | 100 | 500 |
|---|---|---|---|---|---|
| Example 3 | 58 | 60 | 60 | 59 | 55 |
| Comparative Example 1 | 55 | 51 | 44 | 39 | — |

Example 4

The wash oil used in Example 1 was azeotropically distilled with ethylene glycol by repeating the procedure of Example 1 to obtain a denitrified 1-MN-containing oil having a nitrogen content of 0 003% by weight and a concentration of sulfur compounds of 2.8% by weight. The denitrified 1-MN-containing oil was hydrodesulfurized by repeating the hydrodesulfurization procedure of Example 1, and the resulting hydrodesulfurized oil was charged in a distillation tower, wherein the oil was subjected to a batch distillation to sequentially distill off a cut containing ethylbenzene and naphthalene, a cut containing methyltetralin, a cut containing 2-MN, an intermediate cut containing both 2-MN and 1-MN, and a cut mainly comprising 1-MN, and finally, higher boiling components including dimethylnaphthalene, diphenyl, and the like were removed from the bottom. The 2-MN containing cur had a purity of the 2-MN of 98%, and the recovery was 84% based on the amount of the 2-MN in the wash oil in the distillation tower at the start. Next, the methyltetralin-containing cut and the cut mainly comprising the 1-MN were mixed to produce a stock for the subsequent isomerization. The isomerization stock contained 1.5% by weight of methyltetralin, 70% by weight of 1-MN, and 25% by weight of 2-MN. The isomerization stock was fed to an isomerization installation having packed therein the same solid acid catalyst as the one used in Example 1, and isomerization was carried out under the same conditions as Example 1 to obtain an isomerized oil in which content of the 2-MN had been increased to 60% by weight. Next, the thus obtained isomerized oil was mixed with the intermediate cut containing both 1-MN and 2-MN obtained in the above-described distillation and a freshly hydrodesulfurized oil obtained by repeating the above-described procedure to produce a new stock for the next batch distillation. The isomerization step was continuously carried out, and activity of the isomerization catalyst was maintained at a fair level throughout the 150 days of the operation, and isomerized oil after 150 days of the operation had a 2-MN content of 55% by weight

COMPARATIVE EXAMPLE 2

The procedure of Example 4 was repeated except that the methyltetralin cut obtained in the batch distillation step was excluded from the isomerization stock. As a consequence, the isomerization catalyst became gradually deteriorated to exhibit substantially no isomerization after 60 days of the operation As demonstrated above, according to the method of the present invention, activity of the isomerization catalyst is maintained at a satisfactory level for a prolonged period of operation. Accordingly, the present method is capable of producing a highly pure 2-methylnaphthalene from 1-methylnaphthalene-containing oil at a high yield for a prolonged period, leading to an economical advantage.

We claim:

1. A process for preparing 2-methylnaphthalene comprising the steps of azeotropically distilling a 1-methylnaphthalene-containing oil with ethylene glycol to produce a 1-methylnaphthalene-containing oil having a reduced content of nitrogen compounds;

subjecting the 1 methylnaphthalene-containing oil having the reduced content of nitrogen compounds to an isomerization treatment to promote an isomerization from 1-methylnaphthalene to 2-methylnaphthalene and produce an isomerization product; and recovering 2-methylnaphthalene from the isomerization product.

2. The process for preparing 2-methylnaphthalene of claim 1, wherein the isomerization is catalytically promoted by using zeolite Y having a lattice constant of not more than 24.37 Å.

3. The process for preparing 2-methylnaphthalene of claim 1, wherein the 1-methylnaphthalene-containing oil is an oil produced from coal tar.

4. The process for preparing 2-methylnaphthalene of claim 1 further comprising the step of, after the azeotropic distillation, hydrodesulfurizing a portion or all of the 1-methylnaphthalene-containing oil having the reduced content of nitrogen compounds obtained by the azeotropic distillation to produce a hydrodesulfurized product so that the hydrodesulfurized product alone or the hydrodesulfurized product together with the non-hydrodesulfurized 1-methylnaphthalene-containing oil can be subjected to the subsequent isomerization step.

5. The process for preparing 2-methylnaphthalene of claim 4, wherein the hydrodesulfurization is catalytically promoted by using a hydrodesulfurization catalyst containing at least one member selected from the group consisting of molybdenum, cobalt and nickel.

6. The process for preparing 2-methylnaphthalene of claim 1 further comprising the step of, after the azeotropic distillation, hydrogenating a portion or all of the 1-methylnaphthalene-containing oil having the reduced content of nitrogen compounds obtained by the azeotropic distillation to produce a hydrogenated product so that the hydrogenated product alone or the hydrogenated product together with the non-hydrogenated 1-methylnaphthalene-containing oil can be subjected to the subsequent isomerization step.

7. The process for preparing 2-methylnaphthalene of claim 6, wherein the hydrogenation is catalytically promoted by using a copper-chromite catalyst or a catalyst containing at least one member selected from Group VIII metals.

8. A process for preparing 2-methylnaphthalene comprising the steps of azeotropically distilling a 1-methylnaphthalene-containing oil with ethylene glycol to produce a 1-methylnaphthalene-containing oil having a reduced content of nitrogen compounds;

subjecting the 1-methylnaphthalene-containing oil having the reduced content of nitrogen compounds to a hydrogenation or a hydrodesulfurization treatment to produce a hydrogenated or a hydrodesulfurizated product, respectively;

subjecting the treated oil to a distillation step (A) together with a cut recycled from a distillation step (B) to separate a cut of tetralin compounds, a 2-methylnaphthalene cut, and a cut containing both 1-methylnaphthalene and 2-methylnaphthalene, the 2-methylnaphthalene cut being recovered from the system as a product;

subjecting the cut containing both 1-methylnaphthalene and 2-methylnaphthalene and at least a portion of the cut of tetralin compounds to an isomerization treatment to promote an isomerization from 1 methylnaphthalene to 2-methylnaphthalene to produce an isomerized product;

subjecting the isomerized product to the distillation step (B) to remove components having a boiling point higher and/or lower than 1-methylnaphthalene and 2-methylnaphthalene from the system to leave a residual cut; and recycling the residual cut from the distillation step (B) to the distillation step (A).

9. The process for preparing 2-methylnaphthalene of claim 8, wherein the hydrodesulfurization is catalytically promoted by using a hydrodesulfurization catalyst selected from the group consisting of catalysts having at least one member selected molybdenum, cobalt and nickel loaded thereto.

10. The process for preparing 2-methylnaphthalene of claim 8, wherein the hydrogenation is catalytically promoted by using a copper chromite catalyst or a catalyst containing at least one member selected from Group VIII metals 11. The process for preparing 2-methylnaphthalene of claim 8, wherein the isomerization is catalytically promoted by using zeolite Y having a lattice constant of not more than 24 37 Å.

12. The process for preparing 2-methylnaphthalene of claim 8, wherein the 1-methylnaphthalene-containing oil is an oil produced from coal tar.

13. A process for preparing 2-methylnaphthalene comprising the steps of azeotropically distilling a 1-methylnaphthalene-containing oil with ethylene glycol to produce a 1-methylnaphthalene-containing oil having a reduced content of nitrogen compounds;

subjecting the 1 methylnaphthalene-containing oil having the reduced content of nitrogen compounds to a distillation step (C) together with a cut recycled from a distillation step (D) to separate a 2-methylnaphthalene cut and a cut containing both 1-methylnaphthalene and 2-methylnaphthalene, the 2-methylnaphthalene cut being recovered from the system as a product;

subjecting the cut containing both 1-methylnaphthalene and 2-methylnaphthalene to a hydrogenation or a hydrodesulfurization treatment to produce a hydrogenation or a hydrodesulfurization product, respectively;

subjecting the treated oil to an isomerization treatment to promote an isomerization from 1-methylnaphthalene to 2-methylnaphthalene to produce an isomerized product;

subjecting the isomerized product to the distillation step (D) to remove components having a boiling point higher and/or lower than 1-methylnaphthalene and 2-methylnaphthalene from the system to leave a residual cut; and recycling the residual cut from the distillation step (D) to the distillation step (C).

14. The process for preparing 2-methylnaphthalene of claim 13, wherein the hydrodesulfurization is catalytically promoted by using a hydrodesulfurization catalyst selected from the group consisting of catalysts having at least one member selected molybdenum, cobalt and nickel loaded thereto.

15. The process for preparing 2-methylnaphthalene of claim 13, wherein the hydrogenation is catalytically promoted by using a copper-chromite catalyst or a catalyst containing at least one member selected from Group VIII metals.

16. The process for preparing 2-methylnaphthalene of claim 13, wherein the isomerization is catalytically promoted by using zeolite Y having a lattice constant of not more than 24.37 Å.

17. The process for preparing 2-methylnaphthalene of claim 13, wherein the 1-methylnaphthalene-containing oil is an oil produced from coal tar.

* * * * *